US006318838B1

(12) United States Patent
Anderson et al.

(10) Patent No.: US 6,318,838 B1
(45) Date of Patent: Nov. 20, 2001

(54) NON-FIBEROUS SPITTOON CHIMNEY LINER FOR INKJET PRINTHEADS

(75) Inventors: Jeffrey J. Anderson, Vancouver; Russell P. Yearout, Brush Prairie; Steen T. Bidelman, Battle Ground, all of WA (US); Paul A. Williams, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/540,599

(22) Filed: Mar. 31, 2000

(51) Int. Cl.[7] ..... B41J 2/165
(52) U.S. Cl. ..... 347/36; 347/34
(58) Field of Search ..... 347/34, 35, 36, 347/89, 90

(56) References Cited

U.S. PATENT DOCUMENTS

| | | |
|---|---|---|
| 4,024,548 | 5/1977 | Alonso et al. . |
| 5,563,639 | 10/1996 | Cameron et al. . |
| 5,617,125 | 4/1997 | Chew . |
| 5,742,303 | 4/1998 | Taylor et al. . |
| 5,774,141 | 6/1998 | Cooper et al. . |

OTHER PUBLICATIONS

Hewlett–Packard Company Patent Application filed Feb. 16, 1995, Serial No. 08/390,343, entitled "Aerosol Reduction System For Inkjet Printheads", now abandoned.

Hewlett–Packard Company Patent Application filed Mar. 3, 1995, Serial No. 08/397,813, entitled "Antistatic Treatment System For Inkjet Printing Mechanisms", now abandoned.

Hewlett–Packard Company Patent Application filed Jul. 31, 1995, Serial No. 08/509,070, entitled "Absorbent Moveable Spitting Station For Inkjet Printheads", now abandoned.

*Primary Examiner*—Huan Tran
(74) *Attorney, Agent, or Firm*—Flory L. Martin

(57) ABSTRACT

A spittoon system is provided for an inkjet printing mechanism to handle waste inkjet ink spit from an inkjet printhead during a nozzle clearing, purging or "spitting" routine. The spittoon system includes a frame defining a spittoon chamber having an entrance mouth, and a chimney passageway extending between the mouth and the chamber. A hard porous plastic liner lines this passageway from the mouth and into the chamber, with the liner material having no troublesome fibers projecting from a spit target platform so the platform can be located closer to the printhead than the earlier fiberous liners. This close spit target to printhead spacing, along with a larger spit target area traps inkjet aerosol and misdirected ink droplets ejected during a spitting routine. A method of purging ink residue from an inkjet printhead, along with an inkjet printing mechanism having such a spittoon system, are also provided.

25 Claims, 5 Drawing Sheets

NON-FIBEROUS SPITTOON CHIMNEY LINER FOR INKJET PRINTHEADS

FIELD OF THE INVENTION

The present invention relates generally to inkjet printing mechanisms, and more particularly to a spittoon system having an lined entrance chimney which has a non-fiberous, hard porous plastic liner that captures ink droplets and troublesome inkjet aerosol generated by an inkjet printhead during a nozzle clearing, purging or "spitting" routine.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Narrower printheads may lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. However, the combination of small nozzles and quick-drying ink leaves the printheads susceptible to clogging, not only from dried ink or minute dust particles, such as paper fibers, but also from the solids within the new inks themselves.

To clear clogged nozzles, frequent spitting routines are performed before, during, and after a print job. Unfortunately, the spitting operation generates inkjet aerosol, small minute ink particles or satellites which become detached from the main ink droplet and begin floating through the printer. These floating inkjet aerosol satellites may be carried by air currents flowing through the printer to land in undesirable locations. Often the inkjet aerosol lands on critical components inside the printer casing, for instance, resulting in fogging of the optical encoder used in carriage position control, or fouling portions of the casing and carriage where an operator would touch when installing a new pen. Sometimes this aerosol is deposited in the media path through the printer and then picked up by the next sheet of print media, leading to print quality defects.

While some inkjet aerosol maybe generated during a normal printing operation, the effect of this aerosol is not as severe as that generated during the spitting operation because during printing, the media is closer to the printhead than the typical spittoon target area is during spitting. For instance, when ink droplets are ejected to form images on media, the printhead is usually spaced about one millimeter (1 mm) above the media. In contrast, when ink droplets are ejected during a spitting routine, the vertical distance between the printhead orifice plate and the spittoon target surface is usually greater than five millimeters (>5 mm). Since there is a tendency sometimes for the ejected droplets to shoot at an angle other than 90° from the orifice plate, referred to as a misdirected droplet, a larger distance between the orifice plate and the target leads to a greater drop trajectory error. Thus, it would be desirable to have a spit target which is large enough to collect any misdirected ink droplets. Moreover, this greater distance which a droplet must travel before impacting the spit target gives the droplet, and any associated inkjet aerosol, a greater chance to drift away from the intended spit target, due to the air currents flowing within the printer and due to electrostatic charges on the droplets, aerosol satellites, and surrounding printer components. While a simple solution may appear to be just merely making the spittoon target area larger, this impacts other printer design constraints, such as the desire to provide a compact printer with a small footprint which occupies a minimal amount of desktop or workspace.

In the past, several different approaches have been used to control inkjet aerosol, including modified spittoons, absorbers, and fans. First, regarding spittoon design, spittoons are essentially large buckets over which the pens are parked when droplets are ejected during a spitting routine. Unfortunately, spittoon design constraints often restrict the top of the bucket from being close enough to the pen face to limit the spread of the droplets caused by trajectory errors, air currents, electrostatic charges, etc. Moreover, the opening at the top of the bucket must be sized large enough so most of the droplets reach the bottom of the bucket, rather than impacting the bucket sides. Droplets hitting the sides of the bucket often dry there, and in some instances have eventually formed a solid ink bridge across the bucket. Such an ink residue bridge greatly decreases the capacity of the bucket because ink residue then builds up from the bridge, rather than from the bottom of the bucket, until in a worst case scenario the residue reaches the pen face, most likely leading to a pen failure. The combined effects of the restricted size of the top of the bucket and its location away from the pen face often result in some of the ink droplets and aerosol being captured by internal air currents and carried away for deposit in undesirable locations.

The second manner of controlling ink aerosol involves using various absorbers. These absorbers are usually made of some type of a fiber, such as a felt, sponge, or other type of porous material which lines the bottom of the spittoon. Using these absorbers, droplets of ink are typically wicked through capillary forces from the top of the bucket toward the bottom of the bucket. This wicking action prevents the bridging of ink residue across the spittoon. Unfortunately, these absorbers often need to be spaced five millimeters (5 mm) or more from the pen orifice plate, often to prevent loose fibers on the surface of the absorber from contacting the printhead, or due to tolerance issues stemming from the material composition or the fabrication techniques used to make the absorber. For instance, if the absorber is formed through a die-cutting process, any irregularities in the die may lead to uneven cuts, which may leave portions of the absorber projecting into the printhead path if a closer pen-to-absorber spacing was used. Moreover, the width of the absorber is often limited by the space allocated within the printer, so without impacting the printer footprint, the absorber cannot be made large enough to compensate for worst case drop trajectory errors which exacerbated by the larger absorber-to-orifice-plate distances. Thus, typical absorbers also fall short of controlling inkjet aerosol due to these various design, material and manufacturing constraints.

A third way to control inkjet aerosol has been through the use of forced ventilation provided by one or more fans. Ventilation fans have been a powerful inkjet et aerosol control technique, essentially creating air currents that pull the aerosol through the printer. As the air stream flows through the printer, the floating aerosol satellites are entrained within the air stream, which is then forced through a filter to remove the aerosol particles. Such an aerosol controlling fan and filter assembly was first used on the Hewlett-Packard Company's model 850C DeskJet® color inkjet printer. Unfortunately, while the fan and filter assembly performed very well, it increased both the overall initial cost to consumers, and operating costs from electricity consumed by the fan.

Thus, it would be desirable to have spittoon system which captures ink aerosol and misdirected ink droplets generated during a spitting routine before these droplets and aerosol satellites float away to land at other undesirable locations.

SUMMARY OF THE INVENTION

According to one aspect of the present invention, a lined chimney spittoon system is provided for receiving ink residue spit from an inkjet printhead in an inkjet printing mechanism. The spittoon system includes a frame defining at least portions of a spittoon chamber, a spittoon entrance mouth, and a chimney passageway extending between the mouth and the chamber. The spittoon system also has a liner of a hard porous plastic material lining the chimney passageway from the mouth and extending into the spittoon chamber. In a preferred embodiment, the liner material has no fibers projecting from the liner at the spittoon entrance mouth.

According to a further aspect of the present invention, an inkjet printing mechanism may be provided with a lined chimney spittoon system for handling waste inkjet ink as described above.

An overall goal of the present invention is to provide an inkjet printing mechanism which prints sharp vivid images over the life of the printhead and the printing mechanism.

Still another goal of the present invention is to provide a lined chimney spittoon system that efficiently captures wandering inkjet ink aerosol generated during a printhead purging or spitting routine.

Another goal of the present invention is to provide a lined chimney spittoon system and method for receiving ink spit from printheads in an inkjet printing mechanism to provide consumers with a reliable, robust inkjet printing unit.

BRIEF DESCRIPTION OF THE DRAWINGS

FIGS. 6 and 7 are top plan views of a sheet of paper which was residing in an input tray of an inkjet printer during a typical color ink spitting routine, with:

FIG. 6 showing a residual ink pattern generated using a prior art spittoon system; and FIG. 7 showing a residual ink pattern generated using the lined chimney spittoon system of FIGS. 1–4.

DETAILED DESCRIPTION OF A PREFERRED EMBODIMENT

Figure 1:
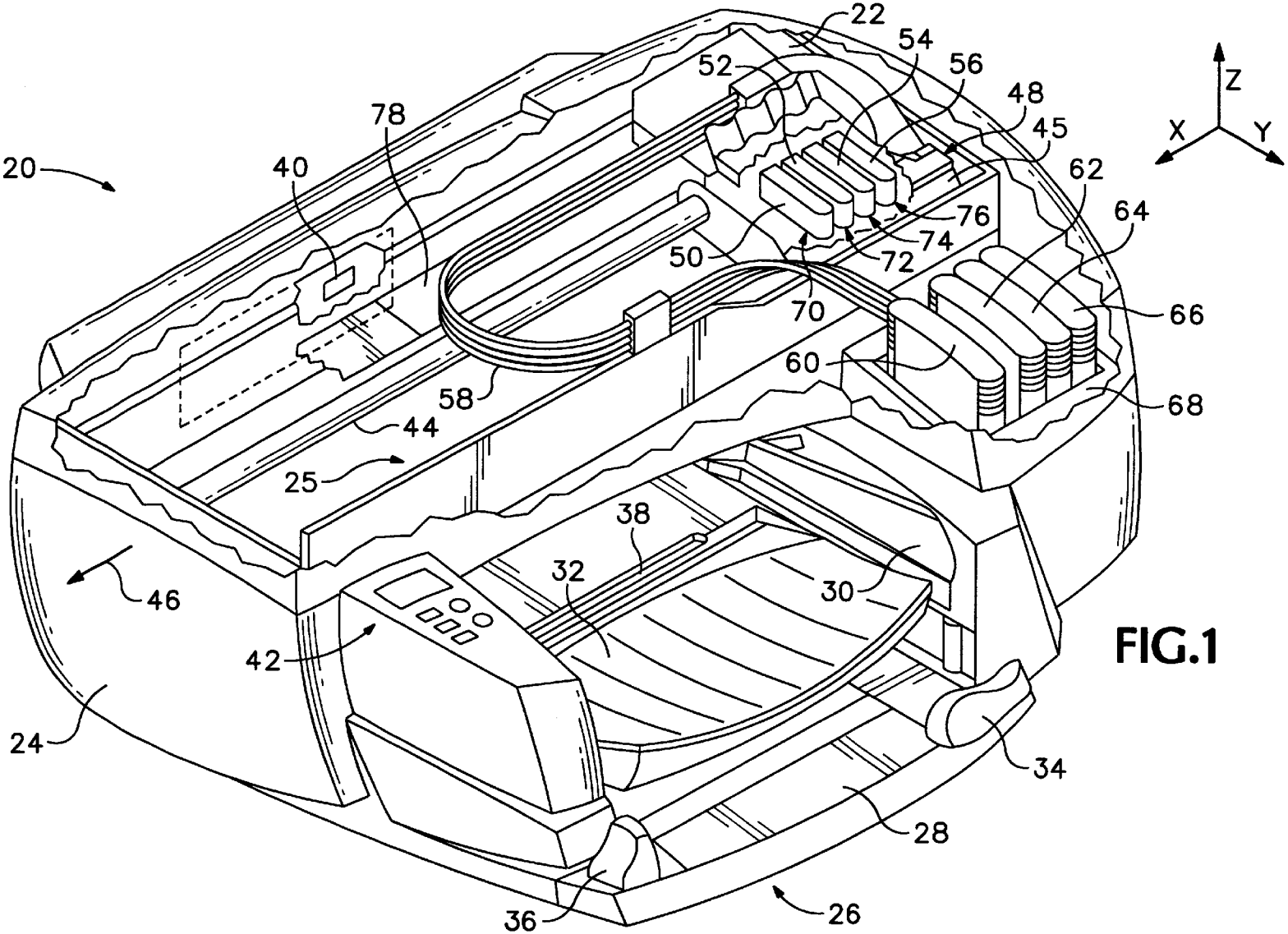
FIG. 1 is a perspective view of one form of an inkjet printing mechanism, here, an inkjet printer, including a printhead service station having one form of a lined chimney spittoon system of the present invention for servicing inkjet printheads.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a DC (direct current) or stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42, which may include a display screen, located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slidably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the printzone 25, a media sheet receives ink from an inkjet cartridge, such as a black ink cartridge 50 and three monochrome color ink cartridges 52, 54 and 56, shown schematically in FIG. 1. The cartridges 50–56 are also often called "pens" by those in the art. The black ink pen 50 is illustrated herein as containing a pigment-based ink. While the illustrated color pens 52–56 each contain a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a series of ink-ejecting nozzles which may be manufactured in a variety of conventional ways well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Lined Chimney Spittoon System For Handling Waste Inkjet Ink

Figure 2:
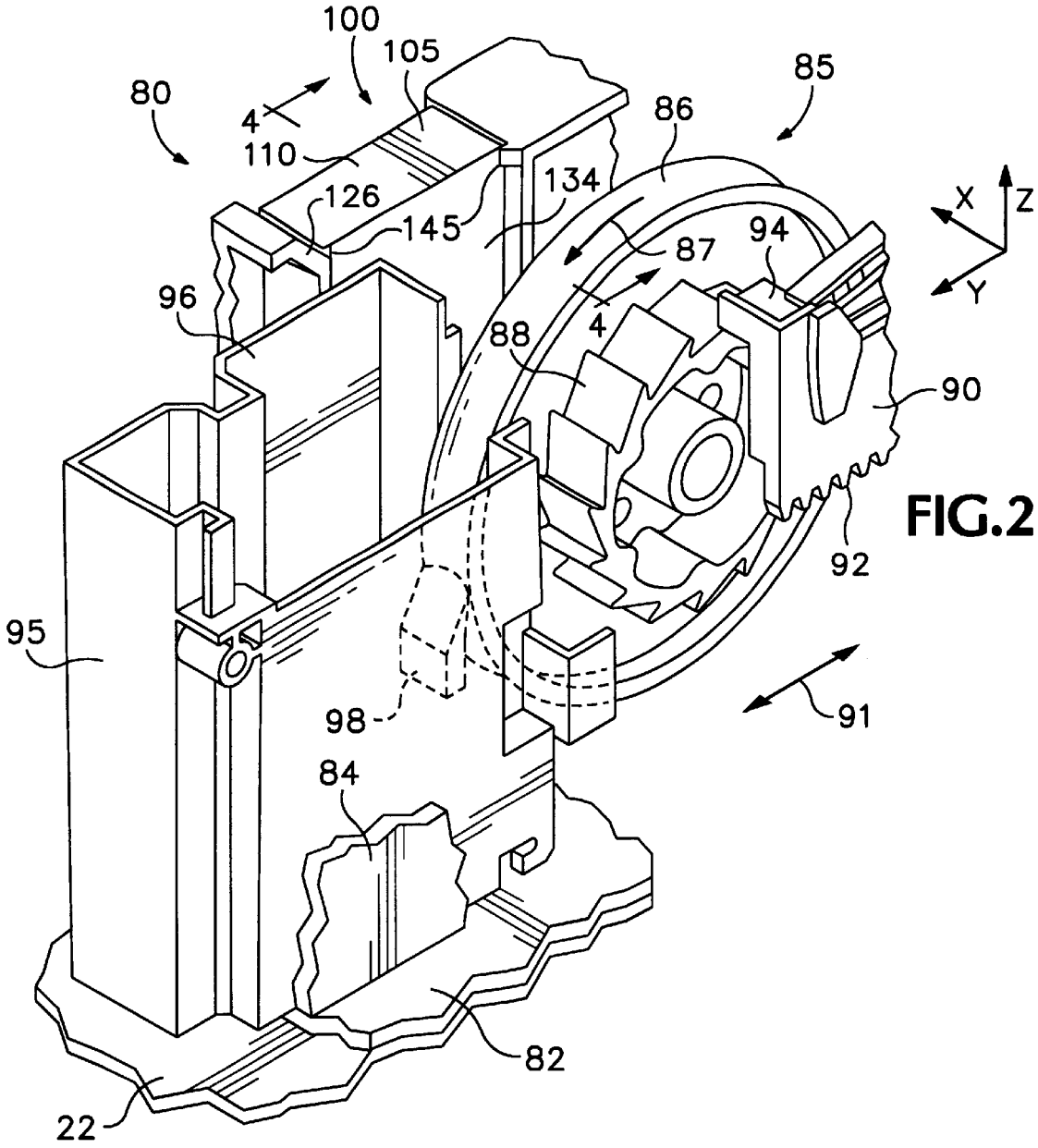
FIG. 2 is a perspective view of a portion of one form of the service station of FIG. 1 showing a black ink spit station and a color ink spit station which together form a spittoon portion of the service station.

FIG. 2 illustrates one form of a service station 80 constructed in accordance with the present invention for servicing the black and color printheads 70–76. The service station 80 has a main frame 82 which is supported by the printer chassis 22 in the servicing region 48 inside the printer casing 24. The service station frame 82 has an inboard sidewall 84 which is located toward an inboard side of the service station, that is, in the direction of the positive X-axis toward the printzone 25. The inboard sidewall 84 supports a black printhead spittoon or spit station 85, here shown as a ferris-wheel type spittoon including a rotary spitwheel 86 which is pivotally supported by the sidewall 84. The spitwheel 86 preferably has a concave surface around its periphery to receive ink spit from the black printhead 70.

The spitwheel 86 may be rotated in the direction of arrow 87 through the use of a toothed ratchet 88, formed along the outboard side of the spitwheel, although it is apparent that other mechanisms may be used to rotate the spitwheel 86. In the illustrated embodiment, the service station 80 includes a translationally movable pallet 90. The pallet 90 moves back and forth in the direction of arrow 91, that is, parallel to the Y-axis, such as through engagement of a motor and spindle gear assembly (not shown) with a rack gear 92 which is formed along an underside of the pallet 90. The pallet 90 may support a variety of servicing mechanisms, such as printhead caps and wipers (not shown), which are not the subject of the present invention. The black spittoon 85 also includes an ink residue storage bucket 95, which defines an interior ink residue collection chamber 96 to provide long-term storage for the black pigment-based ink residue. To remove the ink residue from the concave surface of the spitwheel 86, the storage bucket 95 may be equipped with a scraper member 98, which preferably has a convex scraping surface sized to be received within the concave spit surface of wheel 86. Through rotation of the spitwheel 86 in the direction of arrow 87, scraper 98 scrapes ink residue from the spitwheel rim and then channels this residue into the storage bucket 95.

The service station 80 also includes a lined chimney color spittoon or spit station 100, constructed in accordance with the present invention, to receive waste ink from the color printheads 72–76. The color spittoon 100 is located further inboard toward the printzone 25 than the black spittoon 85 in the illustrated embodiment, to facilitate simultaneous spitting of the black printhead and at least one of the color printheads.

Figure 3:
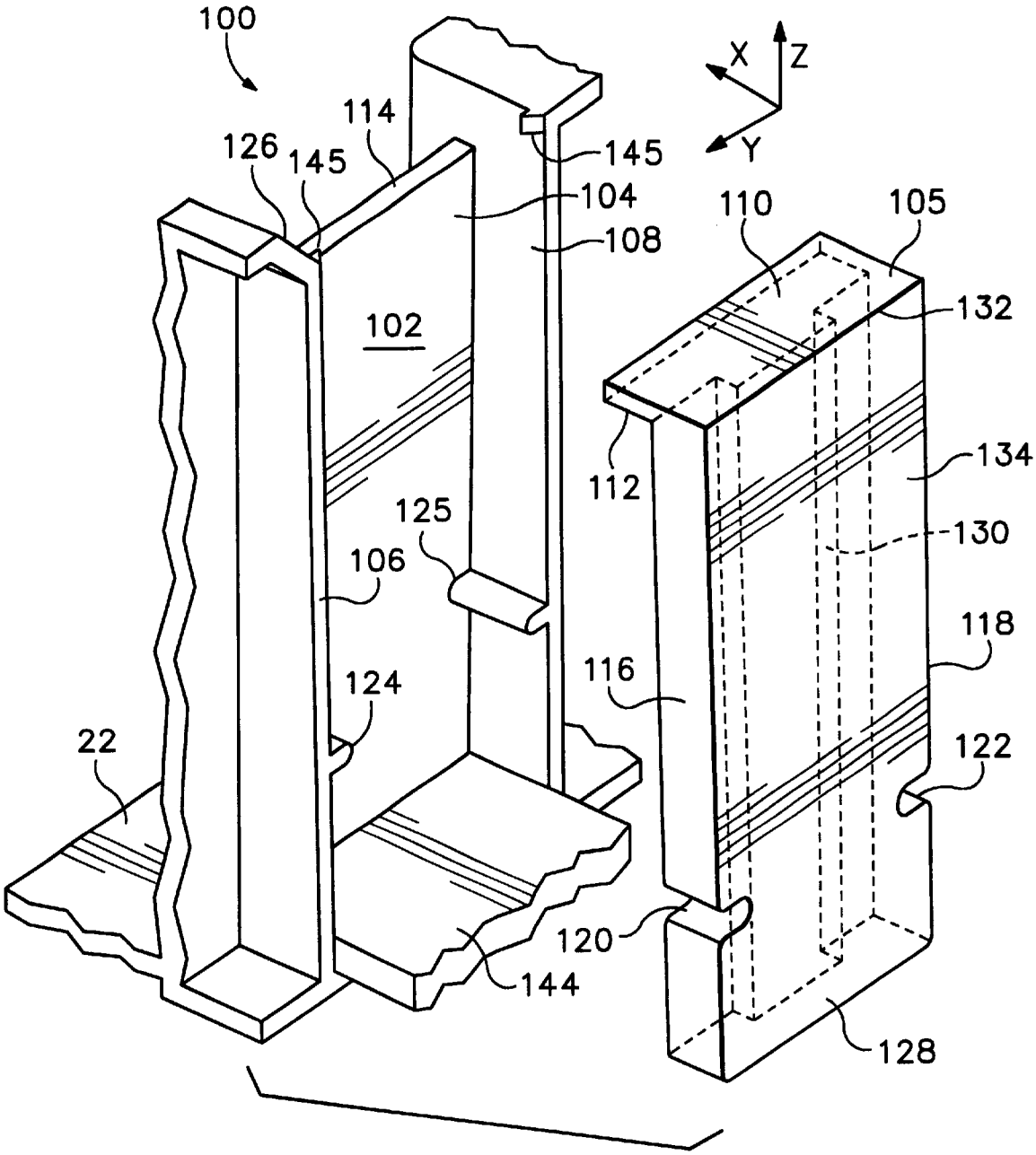
FIG. 3 is an enlarged, exploded perspective view of one form of the color ink spit station of FIG. 2.
Figure 4:
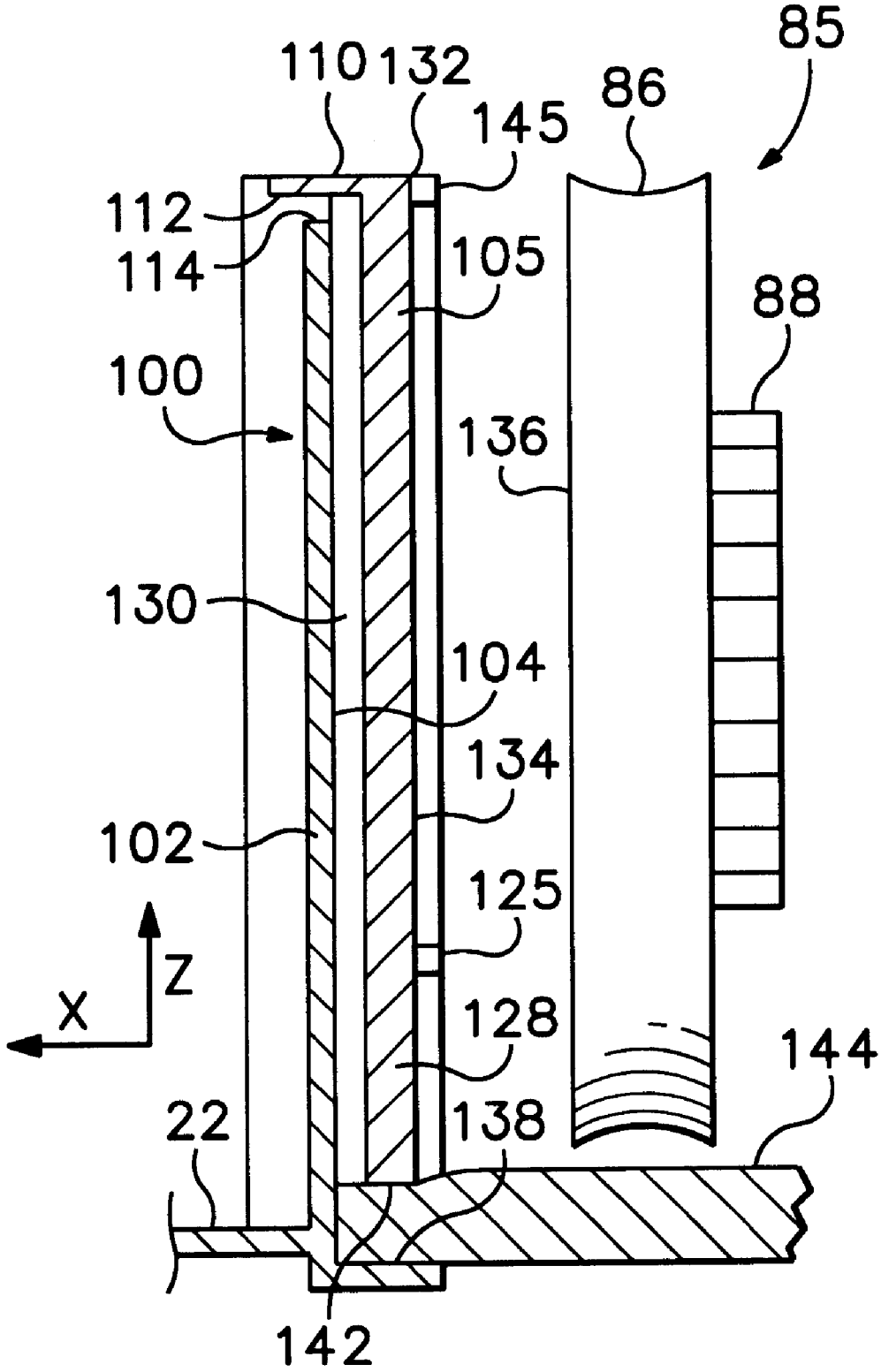
FIG. 4 is a sectional front elevational view taken along lines 4—4 of FIG. 2.

FIGS. 3 and 4 better illustrate the construction of the lined chimney color spittoon 100. Projecting upwardly from a portion of the chassis 22 is an inboard frame sidewall 102 which has an interior surface 104 that forms a portion of the spittoon chimney. The color spittoon 100 also has a chimney liner member 105, constructed in accordance with the present invention. Projecting outwardly from surface 104 of the sidewall 102, and upwardly from the chassis 22, is a front wall 106 and a rear wall 108 between which the chimney liner 105 is positioned during assembly. Preferably the chimney liner 105 is molded from a hard porous plastic material, such as an open-cell thermoset plastic, for instance, a polyurethane foam, a modified open cell polyurethane foam, or a sintered polyethylene, such as that sold under the trademark Porex®, manufactured by Porex Technologies, Inc. of Fairburn, Ga. In one preferred embodiment, the hardness of the liner material may be selected from a durometer range of 70–100 on the Shore A scale, or more particularly from a durometer range of 75–95 on the Shore A scale, or even more particularly at a nominal durometer of 85 on the Shore A scale, plus or minus a tolerance value, such as 85+/−5 on the Shore A scale.

The chimney liner 105 in the cross-sectional view of FIG. 4 is seen to have an inverted L-shape, with a spit target platform 110 forming the inverted foot portion of the L-shape. The spit target platform 110 has an undersurface 112, which when assembled, is spaced a small distance away from a top surface 114 of the inboard sidewall 102 to accommodate fabrication tolerances and tolerance variations in the printer components and thermal expansion/contraction during shipping. Referring back to FIG. 3, to secure the spit target 110 at a desired elevation for an optimal printhead-to-target spacing, the liner 105 has opposing front and rear external surfaces 116 and 118, which each define at least one alignment feature, such as a pair of slots or notches 120 and 122, respectively. The notches 120 and 122 are sized to fit over a pair of alignment datum members or rails 124 and 125, projecting outwardly toward each other from the respective front and rear walls 106 and 108. An upper portion of front wall 106 has a slanted surface 126 which provides adequate clearance for the pens 50-56 to pass over the spittoon mouth and further into the servicing region 48 where they may receive further printhead servicing, such as wiping, priming and capping.

Figure 5:
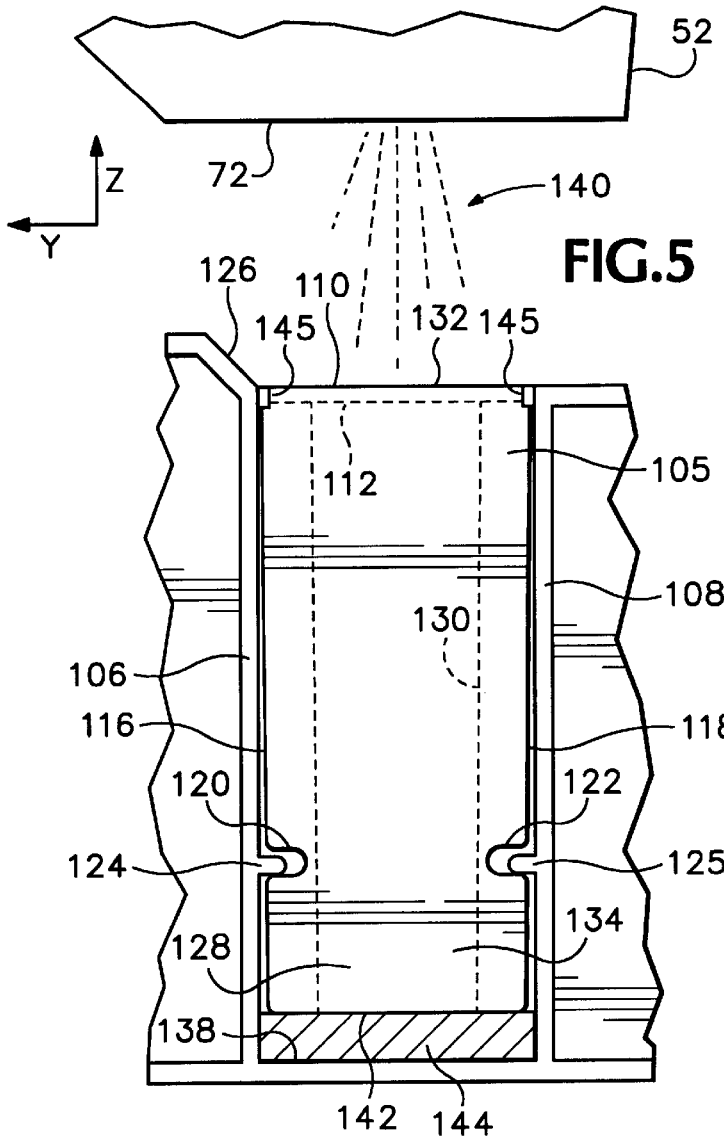
FIG. 5 is a side elevational view of color ink spit station of FIG. 2, shown receiving ink spit from one of the color printheads.

In the illustrated embodiment the chimney liner 105 also includes an upright main body portion 128 which is molded unitarily with the inverted L-shaped foot portion which forms the spit target platform 110. Optionally, the inboard facing wall of the upright body 128 may be hollowed out to define a channel 130 which faces the interior surface 104 of the spittoon inboard sidewall 102. Basically, the channel 130 enhances the manufacturability of the liner while decreasing the material required to mold the liner 105, although other performance benefits may realized by including the channel 130 in liner 105. FIG. 5 illustrates the spitting operation, where ink droplets 140 are being purged from the cyan printhead 72 of pen 52 in the same manner that is used when spitting the magenta and yellow pens 54, 56. To accommodate greater volumes of liquid ink residue, the spittoon floor 138 may also be lined with an absorbent secondary liner member 144. Since the secondary absorber 144 is located remotely away from the printhead, it may be of a fiberous material, such as a stamped polyester material, which was used in the Hewlett-Packard Company's earlier DeskJet Professional Series 2000C color inkjet printer. The liquid components of the ink residue then evaporate from chimney liner 105 and the floor liner 144, leaving the dye-based solid ink components behind for permanent storage in liners 105, 144.

Preferably the chimney liner 105 is designed as a transport mechanism to transport liquid ink residue through capillary forces from the spit target 110 to the floor liner 144. Regarding the relative capillary pressures of the chimney liner 105 and the floor liner 144, conventional design philosophies suggest that the capillary pressure of the chimney liner 105 should be less than or equal to the capillary pressure of the floor liner 144 to gradually wick the liquid ink residue through the chimney liner 105 and into the floor liner 144. However, through experimentation the inventors unexpectedly found that the spittoon system 100 functioned well even if the capillary pressure of the chimney liner 105 was greater than the capillary pressure of the floor liner 144. In the case where the chimney liner 105 had a greater capillary pressure than the floor liner 144, the liquid ink residue accumulated at the bottom of the chimney liner 105 and then was released en mass into the floor liner 144. As long as the liquid ink residue is transported by the chimney liner 105 to the floor liner 144, the spittoon system 100 functions well, regardless of the rate at which the residue is transferred to the floor liner 144, so the relative capillary pressures of the chimney liner 105 and the floor liner 144 were found to be irrelevant, leading advantageously to greater design freedom in material selection.

Preferably, the compliant nature of the secondary absorber 144 is used to push the liner 105 upwardly so the alignment notches 120, 122 ride firmly against the lower surfaces of the frame datum rails 124, 125. This biasing action of the floor liner 144 is seen in FIG. 4, where the liner 144 is compressed between the liner lower surface 142 and the frame floor 138. This biasing force of the floor liner 144 against the upright liner 105 advantageously locates the spit target 110 a selected distance away from the printhead 72. Note in FIG. 5 for the purposes of illustration, there is an exaggerated distance shown between the orifice plate of printhead 72 and the spittoon target 110, although preferably this distance is on the order of three to four millimeters (3–4 mm), which is an improvement over the previous five to seven millimeters (5–7 mm) possible using spittoons filled with fibrous absorbers, as discussed in the Background section above.

The liner 105 is held tightly against the surface 104 of the frame wall 102 by a pair of securement members or tabs 145 projecting inwardly toward each other from the interior surfaces of the frame front and rear walls 106 and 108. For assembly, the floor liner 144 is first positioned over the frame floor 138. The liner 105 is slipped downwardly between the side wall 102 and the tabs 145. Before the bottom surface 142 of the liner encounters the alignment datums 124 and 125, the liner is rotated in a counterclockwise direction with respect to the view of FIG. 4 so the liner body 128 misses the datums 124, 125. When the alignment slots 120 and 122 are over the datums 124, 125, the liner base 142 is rotated clockwise with respect to the view of FIG. 4, compressing the floor liner 144 as the slots 120, 122 are slid over the datum rails 124, 125, until the liner body 128 is resting against the frame wall 102. The tabs 145 and wall 102 then hold the liner body in the X-axis direction. Z-axis alignment of the liner is provided by the interaction of the slots 120, 122 and the datum rails 124, 125 along with the biasing force provided by the compression of the floor liner 144. Y-axis alignment is provided by the front and rear liner walls 116, 118 with the frame walls 106, 108.

The use of the porous plastic color spittoon liner 105 advantageously provides a large target area 110 for maintaining pen health during a printing routine, and for receiving a series of initialization drops deposited during a start-up spit routine after a substantial period of printer inactivity. By using a hard plastic porous material, the absorbent liner 105 may be molded into many shapes, other than that illustrated. Furthermore, the hard porous plastic liner 105 allows tight tolerances to be maintained without having any inherent loose fibers, as was encountered using the earlier fabric, felt or sponge type of absorbers. Thus, by eliminating the inherent loose fibers in the liner material, the spit target 110 may be placed closer to the orifice plate 72 without the risk of having such fibers interfere with the printhead. Moreover, use of the porous plastic Porex® material, or structural equivalents thereto, allows the liner 105 to have a high capillary force which quickly absorbs the ink droplets received on the target 110, which prevents a majority of this waste ink from leaving the liner 105 and leaking into other locations inside the printer 20.

Besides these performance advantages, the chimney liner 105 is also an economically manufactured part, with some quotes being on the order of only $0.25 per liner. In the illustrated embodiment, the main body 128 is approximately 10 millimeters wide, while the target area 110 is on the order of 16 millimeters wide (with width being in the X-axis direction). This particular inverted L-shape design is preferred because it provides a large target 110 for the ink droplets, while also minimizing the overall space consumed within the printer to house the liner 105. Moreover, since the liner 105 may be molded so that critical spacing dimensions may be tightly controlled, and because there are no loose fibers extending from the spit platform 110, the target area 110 may be placed relatively close to the orifice plate, such as on the order of between three and four millimeters (3–4 mm) from the pen face.

One of the most extreme cases of aerosol generation occurs during the pen initialization spitting routine when a new pen 50–56 is installed in the printer 20. This pen initialization spitting routine is used to determine the thermal turn-on energy (TTOE), which is the heat required of each printhead resistor to eject an ink droplet from an associated nozzle orifice. For instance, in the illustrated embodiment over 0.25 milliliters of ink from each of the color pens 52–56 may be ejected by the pens within a 30-second time frame during a typical TTOE spit routine. Thus, a TTOE spitting routine may create a great amount of aerosol in a relatively short period of time.

Figure 6:
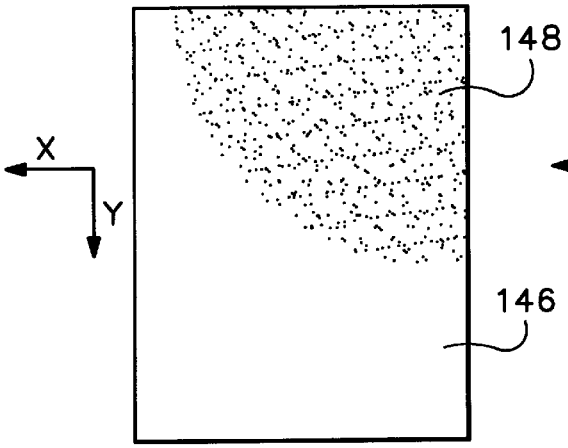
FIG.6 (PRIOR ART)
Figure 7:
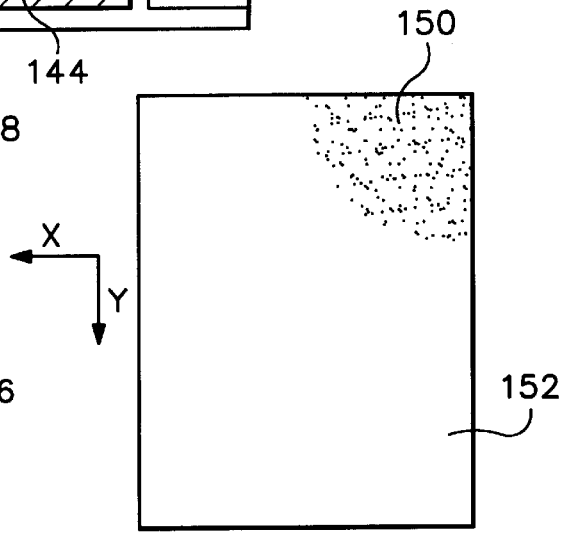

To test the ability of the liner 105 to absorb this ink aerosol, a prototype test was run and then compared to the performance of an earlier felt spittoon liner used in the Hewlett-Packard Company's DeskJet Professional Series 2000C Model Color Inkjet Printer. During this testing, the spacing between the printheads 72–76 and both the prior art felt pad liner and the porous plastic liner 105 was set to about five millimeters (5 mm). In order to record the amount of aerosol generated, a piece of paper was placed in the printer output tray 32 (FIG. 1) to capture any aerosol generated during the TTOE spitting routine which would otherwise have escaped from the interior of the printer casing 24. During testing, a blower fan (not shown) within the printer 20 was disabled, and a TTOE spitting routine was performed on the cyan, magenta and yellow pens 72, 74 and 76. The results of the prior art felt liner are shown in FIG. 6, where we see a sheet of test paper 146, which was placed in output tray 132, has an extensive aerosol pattern 148, which consumes approximately 56% of the sheet. In contrast, FIG. 7 shows a pattern of escaping aerosol 150 on a test sheet 152 which only consumes 14% of the sheet when using the hard porous plastic liner 105 in the color service station 100. Indeed, when the chimney spit target 110 was located at a preferred 3.5 mm distance from the pen orifice plate, only 1% of the test sheet was covered with inkjet aerosol during a TTOE spitting routine. Thus, using the liner 105, the aerosol generated during the worst case pen initialization TTOE spitting routine is nearly eliminated because liner 105 was able to absorb the ink aerosol satellites before they were carried by air 35 currents away from the servicing region 48. A further advantage of the chimney liner 105 was also realized during this testing. Recall that the typical blower fan was turned off during this testing. With such excellent print quality results (only 1% impact) at the preferred 3.5 mm spacing, future designs may be able to eliminate the costly blower fan, leading to a quieter and more economical printer for consumers.

Conclusion

Thus, the lined chimney color spittoon 100 provides the basic functionality of a common felt or sponge liner while greatly improving the amount of inkjet aerosol captured. In the illustrated embodiment, the spit target 110 has an area which is nearly two times greater than the surface area of the orifice plate of printheads 72–76. This larger area of target 110 advantageously enables the absorber 105 to capture almost all of the main droplets and aerosol satellites ejected from the pens 52–56 during spitting routines. By forming the upright body 128 of the liner 105 to be relatively thin (in the X-axis direction) the volume of space occupied by the color spittoon 100 within the printer casing 24 is advantageously minimized. Thus the absorber 105 advantageously yields a more compact printer with smaller footprint.

Moreover, since the absorbent liner 105 is made from a moldable material tight tolerances are achieved and the loose fiber problems experienced with the earlier absorbers are eliminated. The absence of the absorber fibers advantageously allows the spit target 110 to be placed closer to the pen face than a conventional absorber, which further aides in capturing the main ink droplets that may be travelling on a high slightly misdirected trajectory, as well as capturing aerosol satellites before they have the opportunity to drift to undesirable locations, both inside and outside of the printer casing. Capturing these aerosol satellites before they are allowed to migrate through the printer 20 advantageously provides higher print quality, as evidenced by a comparison of the test sheets in FIGS. 6 and 7. Furthermore, a cleaner printer environment is maintained when the majority of this inkjet aerosol is captured before the satellites drift to undesirable locations, such as the printhead carriage 45 and the pens 50–56, leaving the pens cleaner during replacement so an operator's fingers are not unnecessarily soiled by excessive amounts of inkjet aerosol residue. Thus, use of the lined chimney color spittoon 100 advantageously provides consumers with a higher quality print output and a reliable, clean printing unit.

We claim:

1. A spittoon system for receiving ink residue spit from an inkjet printhead in an inkjet printing mechanism, comprising:

a frame defining at least portions of a spittoon chamber, a spittoon entrance mouth, and a chimney passageway extending between the mouth and the chamber; and a liner of a hard porous plastic material lining the chimney passageway from the mouth and extending into the spittoon chamber.

2. A spittoon system according to claim 1 wherein the liner material has no fibers projecting therefrom at the spittoon entrance mouth.

3. A spittoon system according to claim 1 wherein the liner material is of a moldable material.

4. A spittoon system according to claim 3 wherein:

the frame defines at least one alignment datum; and the liner is molded to define at least one alignment feature which rests on an associated at least one frame alignment datum.

5. A spittoon system according to claim 4 wherein:

the frame further defines a floor of the spittoon chamber;

the liner has a bottom surface;

a gap is defined between the bottom surface of the liner and the floor; and the spittoon system further includes an absorbent liner of a compressible material lining the spittoon chamber floor and having a biasing portion compressed within said gap which biases said at least one alignment feature of the liner into contact with said associated at least one frame alignment datum.

6. A spittoon system according to claim 3 wherein the liner material is of an open-cell thermoset material.

7. A spittoon system according to claim 6 wherein the liner material is of a polyurethane foam or of a sintered polyethylene.

8. A spittoon system according to claim 1 wherein the liner has a spit target platform at the entrance mouth.

9. A spittoon system according to claim 8 wherein:

the printhead has a nozzle area through which plural ink-ejecting nozzles project, with the nozzle area being of a first size; and the spit target platform has a target area of second size which is at least twice as large as the first size.

10. A spittoon system according to claim 8 wherein:

the frame has an upper portion at the spittoon entrance mouth; and the spit target platform extends over the upper portion of the frame.

11. A spittoon system according to claim 8 wherein the frame further defines a ramped portion leading down toward the spit target platform.

12. A spittoon system according to claim 1 further including an absorbent liner of a fiberous material in fluid communication with the liner within the spittoon chamber.

13. A spittoon system according to claim 1 wherein:

the frame further defines a floor of the spittoon chamber; and the spittoon system further includes an absorbent liner material lining the spittoon chamber floor and in fluid communication with the liner.

14. A spittoon system according to claim 13 wherein the absorbent liner material lining the spittoon chamber floor is of a fiberous polyester material.

15. An inkjet printing mechanism, comprising:

an inkjet printhead;

a carriage that carries the printhead through a printzone for printing and to a servicing region for printhead servicing; and a spittoon system located in the servicing region to receive ink residue spit from the printhead, with the spittoon system comprising:

a frame defining at least portions of a spittoon chamber, a spittoon entrance mouth, and a chimney passageway extending between the mouth and the chamber; and a liner of a hard porous plastic material lining the chimney passageway from the mouth and extending into the spittoon chamber.

16. An inkjet printing mechanism according to claim 15 wherein the liner material has no fibers projecting therefrom at the spittoon entrance mouth.

17. An inkjet printing mechanism according to claim 15 wherein the liner material is of a moldable material.

18. An inkjet printing mechanism according to claim 1 wherein the liner has a spit target platform at the entrance mouth.

19. An inkjet printing mechanism according to claim 18 wherein:

the printhead has a nozzle area through which plural ink-ejecting nozzles project, with the nozzle area being of a first size; and the spit target platform has a target area of second size which is at least twice as large as the first size.

20. An inkjet printing mechanism according to claim 18 wherein:

the frame has an upper portion at the spittoon entrance mouth; and the spit target platform extends over the upper portion of the frame.

21. A spittoon system according to claim 12 wherein:

said absorbent liner of a fiberous material having a first capillary pressure; and liner within the spittoon chamber is of a material having a second capillary pressure which is greater than said first capillary pressure.

22. A spittoon system according to claim 21 wherein the liner within the spittoon chamber is of a material having no fibers projecting therefrom at the spittoon entrance mouth.

23. An inkjet printing mechanism according to claim 15 wherein the spittoon system further includes an absorbent liner of a fiberous material in fluid communication with the liner within the spittoon chamber.

24. An inkjet printing mechanism according to claim 23 wherein:

said absorbent liner of a fiberous material having a first capillary pressure; and liner within the spittoon chamber is of a material having a second capillary pressure which is greater than said first capillary pressure.

25. An inkjet printing mechanism according to claim 24 wherein the liner within the spittoon chamber is of a moldable material having no fibers projecting therefrom at the spittoon entrance mouth.

* * * * *